US005594189A

United States Patent [19]

Latteri

[11] Patent Number: 5,594,189

[45] Date of Patent: Jan. 14, 1997

[54] TRIPOINT PLECTRUM FOR STRING INSTRUMENTS

[76] Inventor: Keith Latteri, 5122 Blue Ridge Ct., Wallington, N.J. 07057

[21] Appl. No.: 435,730

[22] Filed: May 5, 1995

[51] Int. Cl.[6] ..... G10D 3/16

[52] U.S. Cl. ..... 84/322; D17/20

[58] Field of Search ..... 84/322, 320, 321; D17/20

[56] References Cited

U.S. PATENT DOCUMENTS

| | | | |
|---|---|---|---|
| D. 58,768 | 8/1921 | Knell | D17/20 |
| D. 317,171 | 5/1991 | Saks | D17/20 |
| 768,241 | 8/1904 | Seidel | 84/322 |
| 3,319,505 | 5/1967 | Galetky | 84/322 |
| 4,228,719 | 10/1980 | Keene | 84/322 |
| 4,248,128 | 2/1981 | Des Gaines | 84/322 |
| 4,398,444 | 8/1983 | Walker | 84/322 |
| 4,790,227 | 12/1988 | Lukehart | 84/322 |
| 5,253,562 | 10/1993 | Kline | 84/322 |
| 5,341,715 | 8/1994 | Hucek | 84/322 |

OTHER PUBLICATIONS

Wexler Catalog, Chicago, Illinois, 1965–66, p. 129.

*Primary Examiner*—Cassandra C. Spyrou
*Attorney, Agent, or Firm*—Weingram & Associates

[57] ABSTRACT

A tripoint plectrum for string instruments according to the present invention is formed as a single piece unit having a body portion from which three equally spaced, parallel arranged pick members extend. The central pick member extends further from the body portion than do the outer two pick members and is provided with a peripheral edge which extends beyond a sidewall of the base portion. The one piece construction of the tripoint plectrum permits the central pick and one of the other outer picks to displace the string on both the downstroke and the upstroke while reducing unwanted vibration and resonance.

15 Claims, 1 Drawing Sheet

TRIPOINT PLECTRUM FOR STRING INSTRUMENTS

BACKGROUND OF THE INVENTION

1. Field of the Invention

The present invention relates to plectrum or pick devices used with string instruments.

2. Description of the Related Art

Plectra or pick devices for string instruments are known and described in:

U.S. Pat. No. 768,241 to Seidel which discloses a pick for string instruments which consists of two picking-points arranged side by side and a third picking-point located intermediate the first two picking-points and out of alignment therewith. The pick may be used with the two picking-points in engagement with the strings or with the single intermediate pick point by a slight shift of the pick in the fingers of the operator. The picking-points extend from a corresponding disk all of which are mounted to a post and spaced apart by two collars.

U.S. Pat. No. 3,319,505 to Galetzky discloses a pick for improving the tone of a musical instrument and which includes a grip having two plucking tips angularly spaced approximately 90° apart and symmetrically arranged with respect to a back edge and a center opening of the grip. An annular series of apertures is arranged around the center opening.

U.S. Pat. No. 4,228,719 to Keene discloses a plectrum for stringed musical instruments consisting of a single U-shaped piece of molded resilient plastic which includes two legs at the end each of which is rounded and a formed with hole therethrough.

U.S. Pat. No. 4,248,128 to Des Gaines discloses a guitar pick array consisting of from two to about ten individual guitar picks set into a receiving end of a handle of cured resin, such as epoxy, which holds the picks parallel to each other and spaced-apart. Preferably, the pick tips lie along two lines which are defined by the planes of the pick tips being between 30° and 60° so that the lines cross at an angle lying between about 75° and 105°.

U.S. Pat. No. 4,398,444 to Walker discloses a plectrum having a trifurcated striking means carried by a body of the plectrum for gripping. A body striking part extends from the body while additional striking parts are on opposite sides of the body striking part and angled in relation thereto so that they are inclined from the body and the body striking part.

U.S. Pat. No. 4,790,227 to Lukehart discloses a pick for stringed instruments which consists of three elements laminated together over a portion of their total length with a center element positioned between the two outer elements and protruding beyond the outer elements so that tiered edges are provided for impacting a string of the instrument. A pair of upper segments and a pair of lower segments at opposite sides of the pick elements are utilized for securely gripping the pick.

U.S. Pat. No. 5,253,562 to Kline discloses a plectrum for a stringed instrument which consists of a pair of body plates each of which has a striking projection and a bore extending therethrough, the body plates arranged in a spaced coextensive relationship relative to one another by a spacer ring also having a bore therethrough which is in registration with the bores of the body plates. A fastening means is disposed through the respective bores to fasten the elements together.

U.S. Pat. No. 5,341,715 to Hucek discloses a guitar pick with a stepped ledge finger grip consisting of a tier shaped body having a thin forwardly extending section which tapers to a point to contact strings of an instrument. The body is provided with a stepped up diagonal ledge or surface projecting from each opposite surface of the body in one corner region of the finger grasp end of one surface and in the opposite corner region of the finger grasp end of the opposite surface. Additional embodiments provide for a plurality of raised ledges to be added to each side of the planar body portion.

U.S. Pat. No. Des. 58,768 to Knell discloses a design for a combined implement for stringed musical instruments which consists of what appears to be a bifurcated body portion from which three projections extend, the center projection being of a different shape than the two other projections at opposite sides of the center projection. A spaced element appears to be disposed between the bifurcated body portion.

U.S. Pat. No. Des. 317,171 to Saks discloses a guitar pick which appears to be a singular member extending to a tapered tip portion.

Among the multi-pick plectra discussed above, however, none disclose a multi-point plectrum or pick wherein a plurality of parallel space-apart pick members and body portion for the pick are integrally formed as a single piece unitary structure. The one piece construction of the plectrum of the present invention provides for better control and reduces unwanted vibration and/or resonance which occurs in a plectra formed from discrete elements joined together to form a pick device.

In addition, the unitary structure of the tripoint plectrum of the present invention provides for a less expensive and simpler construction than that required for the known plectra, i.e. the present invention obviates the requirement of the known plectra to pre-assemble the discrete elements of the pick device before they are permanently joined together for use as intended.

OBJECTS AND SUMMARY OF THE INVENTION

It is an object of the present invention to provide a tripoint plectrum for string instruments which is constructed as a one-piece unit, wherein the body or the gripping portion and a plurality of pick members are integrally formed.

Is it another object of the present invention to provide a tripoint plectrum which is constructed to substantially reduce if not eliminate unwanted vibration and/or resonance when the strings of a string instrument are displaced.

It is a further object of the further invention to provide a tripoint plectrum which is constructed so that a substantial portion of each one of the pick members can be employed to displace strings of a string instrument on both the down stroke and upstroke.

It is a further object of the present invention to provide a tripoint plectrum which is simple and inexpensive to manufacture.

It is a further object of the present invention to provide a tripoint plectrum which is constructed to provide a user with a comfortable transition from the use of known plectra.

The foregoing objects are accomplished by providing a plectrum in accordance with the present invention which is constructed as a unitary structure consisting of a single-piece body portion from which a plurality of portions integral therewith extend as pick members, an intermediate one of the pick members extending to a distance further from the single-piece body portion than the remaining plurality of pick members.

An additional feature of the present invention provides for the intermediate pick member and the other pick members to be spaced apart and arranged in parallel with each other.

The result is that a string instrument upon which the plectrum of the present invention is used renders a richer, fuller sound similar to that of an instrument having more strings.

BRIEF DESCRIPTION OF THE DRAWINGS

For a more complete understanding of the present invention, reference may be had to the following descriptions of exemplary embodiments of the present invention considered in connection with the accompanying drawings, in which.

DETAILED DESCRIPTION OF THE PREFERRED EMBODIMENT

Figure 1:
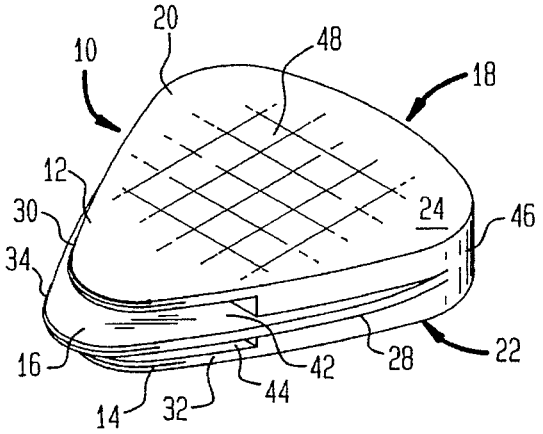
FIG. 1 is a perspective view of a preferred embodiment of a tripoint plectrum for string instruments according to the present invention.

A tripoint plectrum 10 according to the present invention is constructed as a single piece unit to displace a string or strings of string instruments and thereby produce a richer, fuller sound. The structure of the tripoint plectrum 10 substantially reduces if not eliminates unwanted vibration and/or resonance when it is used with string instruments.

Referring to FIGS. 1–6, the tripoint plectrum 10 of the present invention is shown consisting of a plurality of individual pick portions, 12,14,16 formed integral with a base or body portion 18 of the plectrum 10. The pick portions 12,14,16 are flexible.

For purposes of the invention, the term "integral" and its variations, are used to mean a structure of individual pick portions and a base or body portion of one piece construction having no separate or discrete parts or elements which make up the whole, and which are not coupled to each other with mechanical or chemical fasteners.

The base portion 18 has an upper surface 20 and a lower surface 22. The upper surface 20 and the lower surface 20 each provide a corresponding gripping region 24,26 for the plectrum 10.

The upper surface 20 extends to the pick 12, while the lower surface 22 extends to the pick 14. A central portion 28 of the base portion 8 intermediate the upper surface 20 and the lower surface 22 extends to the central pick portion 6. Each one of the picks 12,14,16 have a corresponding peripheral edge 30,32,34 which tapers to a rounded end portion having a correspondingly tapered tip 36,38,40.

A space formed between the picks 12,14 is bisected by the central pick 16 to form spaces 42,44 which are preferably of equal size and shape. The space 42 is provided between the pick 12 and the central pick 16, while the space 44 is provided between the pick 14 and the central pick 16. The spaces 42,44 provide for the picks 12,14,16 to be arranged equi-distant from each other in a spaced-apart parallel relationship as shown particularly in FIGS. 5 and 6. A sidewall 46 of the tripoint plectrum 10 is integrally formed with and to extend to peripheral edges 30,32 of the outer picks 12,14 and a peripheral edge 34 of the central pick 16 as shown in FIG. 1. The peripheral edges 30,32 of the outer picks 12,14 are flush with the sidewall 46 where the peripheral edges 30,32 contact the sidewall 46.

Figure 2:
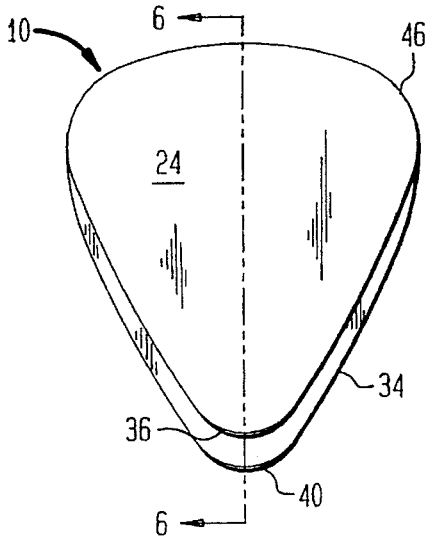
FIG. 2 is a top plan view of the tripoint plectrum according to the present invention, a bottom plan view being identical thereto.
Figure 3:
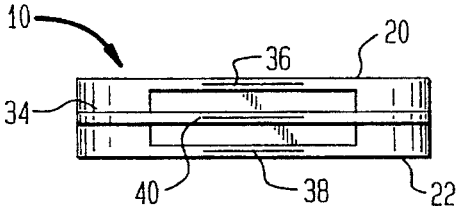
FIG. 3 is an front end elevational view of the tripoint plectrum according to the present invention.
Figure 5:
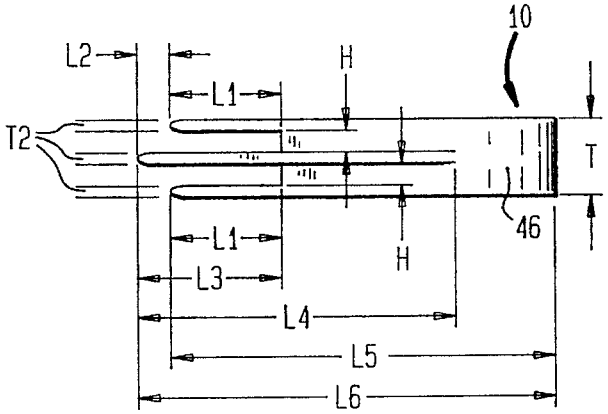
FIG. 5 is a side elevational view of the tripoint plectrum according to the present invention, the opposite side elevational view being identical thereto.
Figure 4:
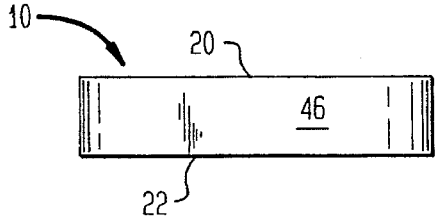
FIG. 4 is a rear end elevational view of the tripoint plectrum according to the present invention.
Figure 6:
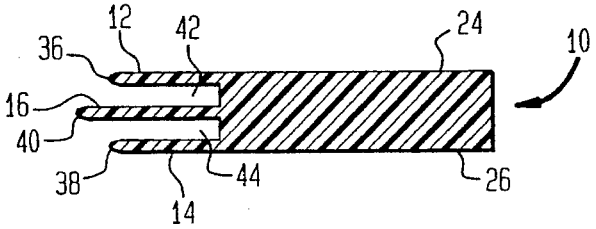
FIG. 6 is a side elevational view in cross section taken along line 6—6 in FIG. 2.

With reference in particular to FIGS. 1, 2 and 5, the central pick 16 extends from the base portion 18 beyond the picks 12,14 to either side. The central pick 16 and at least one of the other picks 12,14 strike or displace an instrument string on both the upstroke and the downstroke across the instrument string (not shown). In addition, the peripheral edge 34 of the central pick 16 extends outward beyond the sidewall 46 of the plectrum 10, and beyond the peripheral edges 30,32 of the outer picks 12,14 in an increasing amount toward the tapered tip 40 of the central pick 16. The peripheral edge 34 of the central pick 16 enables the user to have at his or her disposal more of the plectrum 10 to strike or displace the instrument strings.

Preferably, the tapered tips 36,38 are coplanar, and the plane in which the tapered tip 40 lies is parallel with the plane in which lie the tapered tips 36,38.

The upper and lower surfaces 20,22 of the plectrum 10 are smooth, as are the peripheral edges 30,32,34 which provides for efficient, accurate striking of the instrument strings. Alternatively, a portion of the upper surface 20 and lower surface 22 of the base portion 18 can be machined or knurled with grooves 48 to facilitate the gripping of the plectrum 10. The construction of the plectrum 10 is such that it does not have to be held for use differently than known plectrums thereby providing for a quick, comfortable transition to use the present invention.

The tripoint plectrum 10 of the present invention can be used with any string instrument such as a guitar, banjo, mandolin, lyre, etc. By way of example, a six sting guitar played with the tripoint plectrum 10 benefits by having its sound appear similar to that of a twelve string guitar.

The tripoint plectrum 10 is preferably constructed from plastics or other polymer compositions and formed by injection molding or die punching. The plectrum 10 is molded or die punched as a single piece unit.

The approximate and preferred dimensions of the tripoint plectrum 10 according to the present invention are set forth below in TABLE I and correspond to the reference characters of FIG. 5.

TABLE I

| | DIMENSIONS | |
|---|---|---|
| REFERENCE | APPROXIMATE (METRIC) | PREFERRED (METRIC) |
| T1 | 5.0–7.0 mm | 6.0 mm |
| T2 | 0.3–0.7 mm | 0.5 mm |
| L1 | 8.0–10.0 mm | 9.0 mm |
| L2 | 1.0–4.0 mm | 2.0 mm |
| L3 | 7.0–1.0 cm | 8.0 mm |
| L4 | 2.3–2.7 cm | 2.5 cm |

TABLE I-continued

| REFERENCE | DIMENSIONS APPROXIMATE (METRIC) | PREFERRED (METRIC) |
|---|---|---|
| L5 | 2.8–3.2 cm | 3.0 cm |
| L6 | 3.0–3.2 cm | 3.2 cm |
| H | 1.0–3.0 mm | 2.0 mm |

It will be understood that the embodiments described herein are merely exemplary and that a person skilled in the art may make many variations and modifications without departing from the spirit and scope of the invention. All such modifications and variations are intended to be within the scope of the invention as set forth in the claims herein.

What is claimed is:

1. A one piece plectrum for string instruments, comprising:

a body portion comprising:

opposed surfaces to be gripped, a continuous sidewall interconnecting the opposed surfaces, the continuous sidewall comprising:

a front region, a rear region, opposed side regions;

a pair of spaced-apart pick members integral with the body portion and extending from the front region to a distance from the body portion; and a central pick member integral with the body portion and extending from the front region in the space between the pair of pick members to a distance from the body portion, and a peripheral edge on the central pick member projecting from the opposed side regions of the body portion.

2. The one piece plectrum according to claim 1, wherein the central pick member bisects the space between the pair of pick members and is spaced apart from each one of the pick members.

3. The one piece plectrum according to claim 1, wherein the pair of pick members and the central pick member are spaced-apart in parallel relationship.

4. The one piece plectrum according to claim 1, wherein each one of the pair of pick members extends to a substantially same distance from the body portion.

5. The one piece plectrum according to claim 4, wherein the central pick member extends further from the body portion than the pair of pick members.

6. The plectrum according to claim 1, wherein each one of the pair of pick members comprises:

a peripheral edge flush with the sidewall of the body portion.

7. The one piece plectrum according to claim 6, wherein the peripheral edge of the central pick member projects beyond the peripheral edge of each of the pair of pick members.

8. The one piece plectrum according to claim 1, wherein the opposed surfaces of the body portion are provided with grooves therein to facilitate gripping the body portion.

9. The one piece plectrum according to claim 1, wherein the pair of pick members and the central pick member are flexible.

10. A one piece plectrum for use with string instruments, comprising:

a body portion, comprising:

an upper surface, a lower surface, and a sidewall disposed therebetween to join the upper surface to the lower surface;

a first pick member formed integral with the body portion to extend from the upper surface at a first side of the body portion;

a second pick member formed integral with the body portion to extend from the lower surface at the first side of the body portion in a spaced-apart relationship with the first pick member; and a central pick member extending from the body portion between the first pick member and the second pick member beyond the first pick member and the second pick member and from the sidewall at a second side of the body portion.

11. The one piece plectrum according to claim 10, wherein the first pick member, the second pick member and the central pick member extend from the body portion in a spaced-apart parallel relationship.

12. The one piece plectrum according to claim 10, wherein the first pick member extends from the body portion to a first tip, and the second pick member extends from the body portion to a second tip at a substantially similar distance from the body portion as the first tip.

13. The one piece plectrum according to claim 12, wherein the central pick member extends from the body portion to a central tip further from the body portion than the first tip and the second tip.

14. The one piece plectrum according to claim 10, wherein at least one of the upper surface and the lower surface is provided with grooves therein to facilitate gripping the body portion.

15. A one piece plectrum for string instruments, comprising:

a single-piece body portion having a continuous sidewall with a first side from which a plurality of portions integral therewith extend as pick members, an intermediate one of the pick members extending away from the body portion beyond the plurality of pick members at a second side of the continuous sidewall.

* * * * *